US005649741A

United States Patent [19]

Beggs

[11] Patent Number: 5,649,741

[45] Date of Patent: Jul. 22, 1997

[54] ADJUSTING MECHANISM

[75] Inventor: Ken A. Beggs, Waterloo, Canada

[73] Assignee: Northfield Metal Products Ltd., Ontario, Canada

[21] Appl. No.: 603,038

[22] Filed: Feb. 16, 1996

[51] Int. Cl.[6] ..... B60H 2/02

[52] U.S. Cl. ..... 297/353; 297/411.36

[58] Field of Search ..... 297/353, 411.36; 403/105, 107, 108, 109; 248/297.31

[56] References Cited

U.S. PATENT DOCUMENTS

| | | | |
|---|---|---|---|
| 4,639,039 | 1/1987 | Donovan | 297/353 |
| 4,749,230 | 6/1988 | Tornero | 297/353 |
| 5,037,158 | 8/1991 | Crawford | 297/353 |
| 5,324,096 | 6/1994 | Schultz | 297/353 |
| 5,388,892 | 2/1995 | Tornero | 297/411.36 |

*Primary Examiner*—Peter M. Cuomo
*Assistant Examiner*—Anthony D. Barfield
*Attorney, Agent, or Firm*—Wood, Herron & Evans, L.L.P.

[57] ABSTRACT

An adjusting mechanism for adjusting the position of a first structural member relative to a second structural member. The mechanism is particularly well suited for use as a mechanism for adjusting the vertical or lateral position of a chair back or armrest relative to a chair seat and is adapted for one-handed adjustment. The adjustment mechanism has an arm mountable to a first structural member and slider securable to a second structural member that slidably engages the arm. A ratchet rack is on the arm and a pawl is supported by the slider, which is adapted to engage the ratchet rack, permitting only one direction movement of the slider along the arm. One of the pawl and slider has a cam guide, which has a portion substantially transverse to the ratchet rack and a portion extending from the substantially transverse portion in a direction substantially parallel to the rack. The other of the slider and the pawl has a cam follower extending therefrom. The cam follower, slidably engages the cam guide. A biasing member resiliently pushes the pawl into engagement with the ratchet rack, and forces the cam along the substantially transverse portion of the cam guide, away from the substantially parallel portion of the cam guide. One of the arm and the paw has a first camming surface, the other of the arm and pawl has a first abutting surface. When the pawl first surface is pushed into abutment with the arm first surface, the cam follower is forced along the substantially transverse portion of the cam guide into the substantially parallel portion of the cam guide. The pawl is then disengaged from the ratchet rack, thereby allowing bi-direction motion of the slider along the arm. The arm has a second surface such that when the pawl is pushed into abutment with the second surface of the arm, the cam follower is pushed into the horizontal portion of the cam guide, re-engaging the pawl and ratchet rack.

24 Claims, 8 Drawing Sheets

ADJUSTING MECHANISM

FIELD OF THE INVENTION

The present invention relates to an adjusting mechanism for adjusting the position of a first structural member relative to a second structural member. The mechanism is particularly well suited for use as a mechanism for adjusting the vertical or lateral position of a chair back or armrest relative to a chair seat, and specifically to a device which is adapted for one handed adjustment.

BACKGROUND OF THE INVENTION

In office chairs, it is typically necessary to provide a mechanism which allows the chair user to adjust the vertical or lateral position of the back of the chair back relative to the chair seat. Such a mechanism permits the chair user to customize the chair to accommodate the user's particular size and comfort choices.

In the past, vertical chair back adjusting mechanisms have comprised a slider mounted on a chair back. The slider slidably engages an arm extending upwards from the chair seat. In order to lock the chair back in a fixed position, such mechanisms have further employed a screw assembly extending from the slider. The screw assembly, is typically operable by a lever, knob or handle. The screw mechanism, when tightened, causes a friction fit between the chair back slider and the arm. These known mechanisms, however, are cumbersome as they require a chair user to utilize both hands to effectively adjust the chair back.

Devices allowing one handed vertical adjustment of a chair back relative to a chair seat are known. For example, U.S. Pat. No. 4,749,230 issued Jun. 7, 1988 and naming Tornero as inventor discloses a height adjusting device for a chair backrest employing guided slidably interlocking plates and a locking pin disposed in a slotted track. This device, however, relies on the free sliding of the locking pin and the force of gravity on this pin. Accordingly, as the mechanism becomes dirty and worn it often fails to operate smoothly.

Similarly, U.S. Pat. No. 4,639,039 issued Jan. 27, 1987 and naming Donovan as inventor discloses a height adjustment mechanism for a chair backrest. This mechanism, while effective, utilizes numerous parts, including a coiled torsion spring. It is accordingly somewhat cumbersome to manufacture and assemble.

The present invention attempts to overcome many of the disadvantages of the known devices.

SUMMARY OF THE INVENTION

In accordance with one aspect of the invention, there is provided a chair back adjusting mechanism, comprising an arm, mountable to a chair seat to extend therefrom; a slider securable to a chair back and adjusted to slidably engage said arm; a ratchet rack on said arm; a pawl supported by said slider adapted to engage said ratchet rack; one of said slider and said pawl having a cam guide, said guide having a substantially horizontal portion extending in a direction substantially transverse to said rack, and a substantially vertical portion interconnected to said substantially horizontal portion and extending in a direction substantially parallel to said rack from said substantially horizontal portion; the other of said slider and said pawl having a cam follower extending therefrom, said cam follower slidably engaging said cam guide; a biasing member, resiliently pushing said pawl into engagement with said ratchet rack and forcing said cam follower along said substantially horizontal portion of said cam slot, away from said substantially vertical portion of said cam guide; one of said arm and said pawl having a first camming surface, the other of said arm and said pawl having a first abutting surface such that when said pawl first surface is pushed into abutment with said arm first surface said cam follower is forced along said substantially horizontal cam guide portion and into said substantially vertical cam guide portion; said pawl being disengaged from said ratchet rack when said cam follower is positioned in said substantially vertical portion of said cam guide said arm having a second surface such that when said pawl is pushed into abutment with said second surface of said arm said cam is forced from said substantially vertical portion and into said substantially horizontal portion of said cam guide.

In accordance with another aspect of the invention, there is provided an adjusting mechanism for adjusting the position of a first structural member relative to a second structural member, comprising an arm, mountable to said first structural member to extend therefrom; a slider securable to said second structural member and adapted to slidably engage said arm; a ratchet rack on said arm; a pawl supported by said slider adapted to engage said ratchet rack; one of said slider and said pawl having a cam guide, said guide having a first guide portion extending in a direction substantially transverse to said rack, and a second guide portion interconnected to said first guide portion and extending in a direction substantially parallel to said rack from said first guide portion; the other of said slider and said pawl having a cam follower extending therefrom, said cam follower slidably engaging said cam guide; a biasing member, resiliently pushing said pawl into engagement with said ratchet rack and forcing said cam follower along said first guide portion of said cam slot away from said second guide portion; one of said arm and said pawl having a first camming surface, the other of said arm and said pawl having a first abutting surface such that when said pawl first surface is pushed into abutment with said arm first surface said cam follower is forced along said first guide portion and into said second guide portion; said pawl being disengaged from said ratchet rack when said cam follower is positioned in said substantially second portion of said cam guide; said arm having a second surface such that when said pawl is pushed into abutment with said second surface of said arm said cam follower is forced from said substantially second guide and into said first guide portion of said cam guide.

BRIEF DESCRIPTION OF THE DRAWINGS

In drawings which illustrate a preferred embodiment of the invention,

FIG. 2B is a cross-sectional view taken along 2B—2B in

DETAILED DESCRIPTION OF THE PREFERRED EMBODIMENT

FIGS. 1–4A illustrate a first preferred embodiment of the invention.

Figure 1:
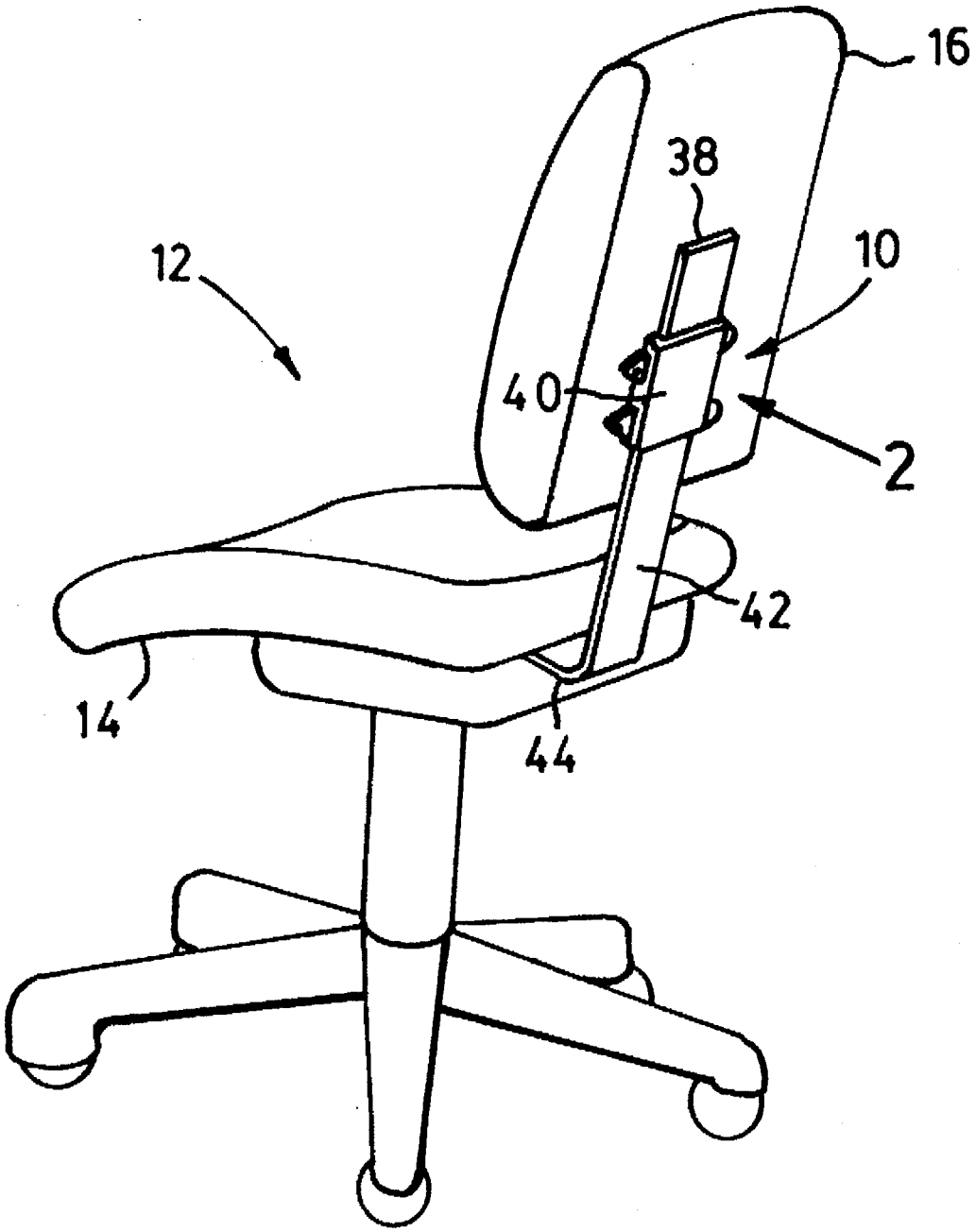
FIG. 1 is a perspective view of an office chair incorporating a chair back adjusting mechanism in accordance with an embodiment of this invention.

FIG. 1 illustrates an adjusting mechanism 10, in accordance with this invention. The mechanism is used as a chair back adjusting mechanism and forms part of a conventional office chair 12. The adjusting mechanism 10 has an arm 38 and slider 40. Arm 38 extends from chair seat 14. Arm 38 consists of a portion 42 extending vertically upward from chair seat 14 and a further portion 44 which attends substantially horizontal and may be attached by way of bolts or screws to the bottom of chair seat 14. Arm 38 is typically made of a material such as metal, and is configured to withstand a typical backward force that might be applied by a user of the chair while resting against chair back 14. Slider 40 is attached to chair back 16, and may be so attached by bolts or screws or other conventional fasteners.

Figure 2:
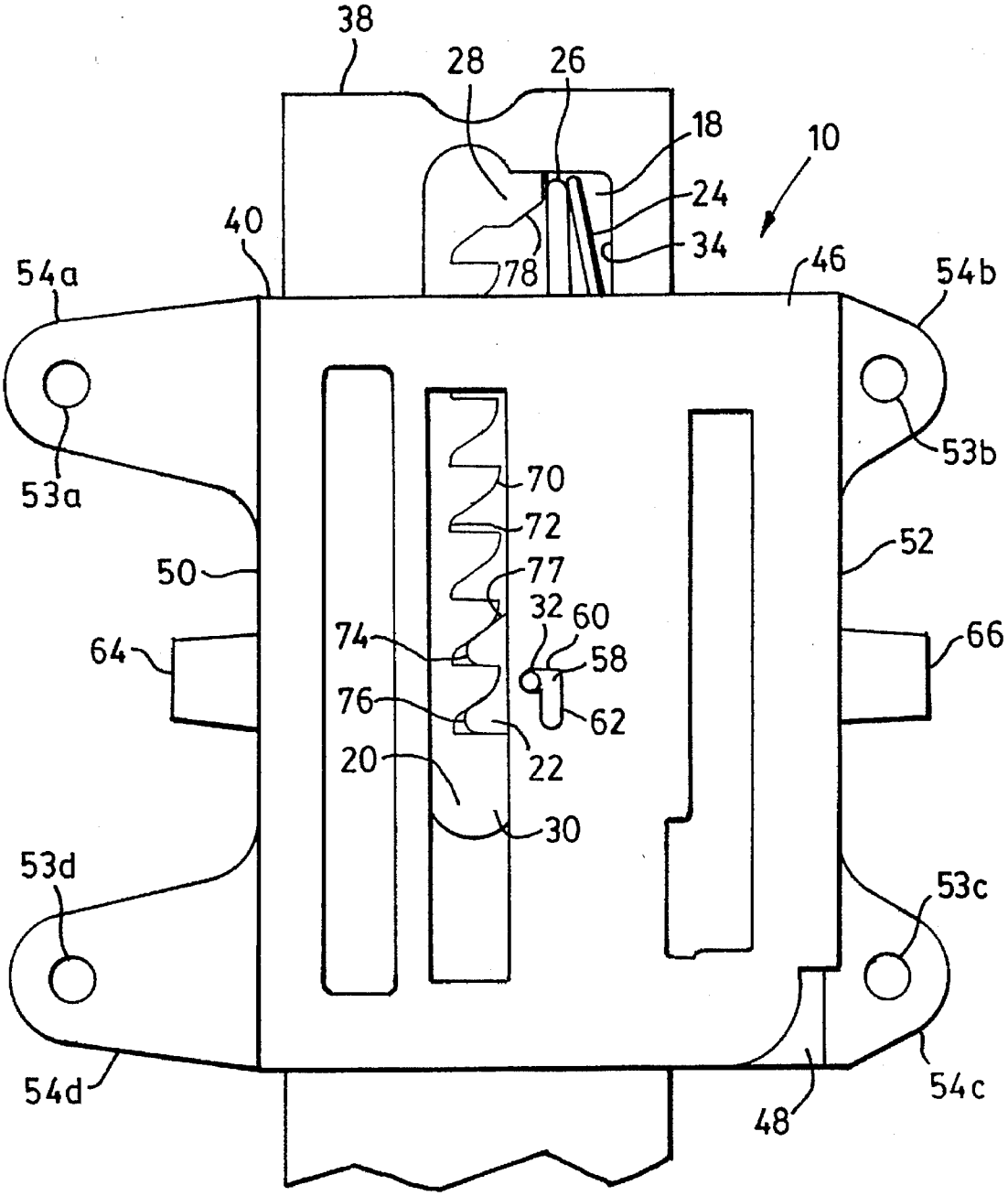
FIG. 2 is a detailed elevational view of part of the chair back adjusting mechanism of the chair of FIG. 1.
Figure 2A:
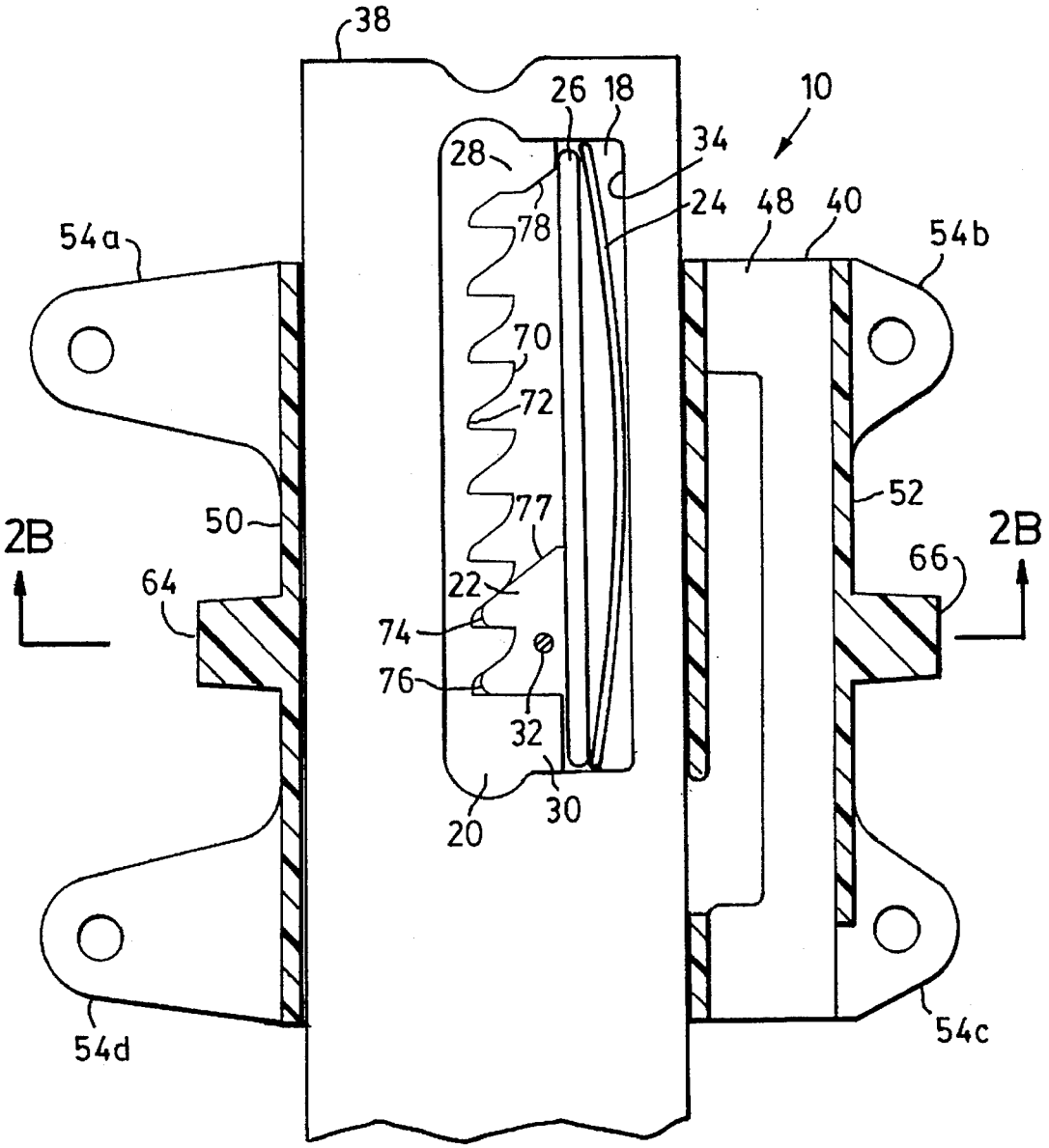
FIG. 2A is a cut-away view of FIG. 2.
Figure 2B:
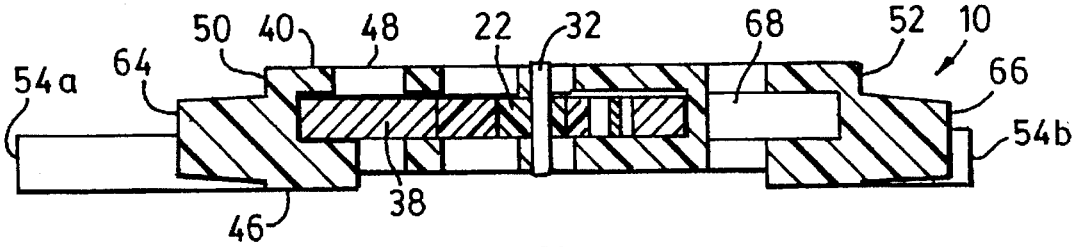

As shown in FIGS. 2, 2A, and 2B, slider 40 comprises two outer walls 46 and 48. Front outer wall 46 and back outer wall 48 oppose each other and are spaced from and are oriented generally parallel to each other. Back outer wall 48 and front wall 46 are interconnected at their side edges by side walls 50 and 52. All these walls may be made of a durable material such as a hard plastic or metal and may be integrally formed. Extending from side walls 50 and 52 are four flanges 54 having retaining holes 53*a–d* for fixedly mounting slider 40 to chair back 16. When mounted on chair back 16, screws or bolts (not shown) extend through the retaining holes 53*a–d* in flanges 54 into chair back 14. Located within walls 46 and 48 are respectively cam guides 58 which take the form of inverted L-shaped cam slots. Guides 58 are identical in shape and size and are disposed opposite each other. Each guide comprises a vertical portion 60 extending parallel to the orientation of a ratchet rack 20 and a horizontal portion 62 extending generally transverse to ratchet rack 20.

A pair of grips 64 and 66 extend outwardly from opposite side walls 50 and 52 of edges of slider 40. As depicted in FIG. 2B, walls 46, 48, 50 and 52 form a channel 68 which receives arm 38.

As shown in FIG. 2A, located within arm 38 is cut-out 18. Mounted within cut-out 18 is ratchet rack 20. Ratchet rack 20 has a number of teeth 70 and a number of gaps 72 between teeth 70. The ratchet rack 20 is made of similar material to walls 46 and 48. Ratchet rack 20 is mounted within cut-out 18 opposite edge 34 of cut-out 18. Ratchet rack 20 alternatively may be integrally formed as part of arm 38 by cut-out 18. A pawl 22 rests and is moveable in cut-out 18 between walls 46 and 48, and is adapted to engage rack 20. Pawl 22 is similarly made of the same material as ratchet rack 20 and walls 46 and 48. The thickness of pawl 22 is approximately equal to the thickness of arm 38.

Pawl 22 has two teeth 74 and 76 for engagement of gaps 72 of rack 20. Pawl 22 further has a camming surface 76. A leaf-spring 24 is positioned between edge 34 of cut-out 18 and a biasing bar 26. Leaf spring 24 is typically fabricated of a resilient metal. Biasing bar 26 is deformable along its length and accordingly is made of a resilient material such as deformable plastic. It also has a thickness approximately equal to the thickness of arm 38. A spring force is exerted by leaf spring 24 on biasing bar 26, causes biasing bar 26 to arc slightly toward ratchet rack 20. As a side of pawl 22 is in abutment with biasing bar 26, this force, in turn, resiliently pressures pawl 22 into engagement with ratchet rack 20. Spacers 28 and 30 extend from the top and bottom of ratchet rack 20, respectively. These spacers 28, 30 space the ends of biasing bar 26 at a minimum distance from ratchet rack 20. Spacer 28 additionally has a camming surface 78, thereby giving pawl 22 freedom of movement.

A cam follower in the form of a retaining pin 32 extends through and is mounted in pawl 22 and engages guides 58 in walls 46 and 48. Retaining pin 32 is typically formed of steel. The length of retaining pin 32 is slightly longer than the sum of the widths of walls 46, 48 and arm 38. Retaining pin 32 may freely slide within guides 58, but remains stationary relative to pawl 22. A considerable coefficient of friction exists between the retaining pin 32 and the walls of guides 58.

In operation, an operator sits on a chair such as the chair shown in FIG. 1. In order to properly adjust the height of chair back 16 relative to chair seat 14, chair back 16 may be pulled in an upwardly direction away from seat 14. Slider 40 slidably engages arm 38 which guides slider 40 and is seated within channel 68. As will be explained below, because of the engagement of slider 40 with arm 38, chair back 16 may not be slid downward toward chair seat 14 until slider 40 is slid to the top of its path along arm 38.

Figure 2C:
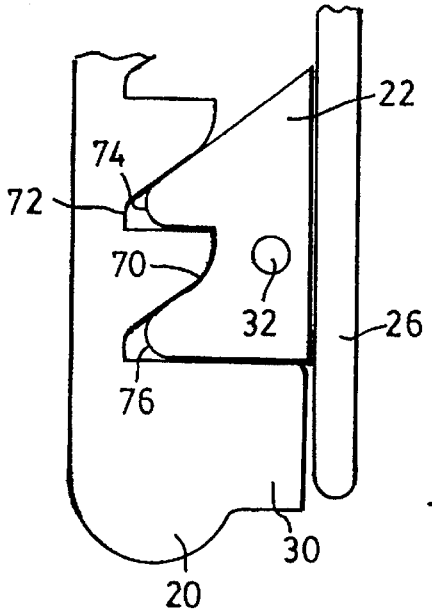
FIG. 2C is an enlarged detailed view of a portion of FIG. 2A.
Figure 3:
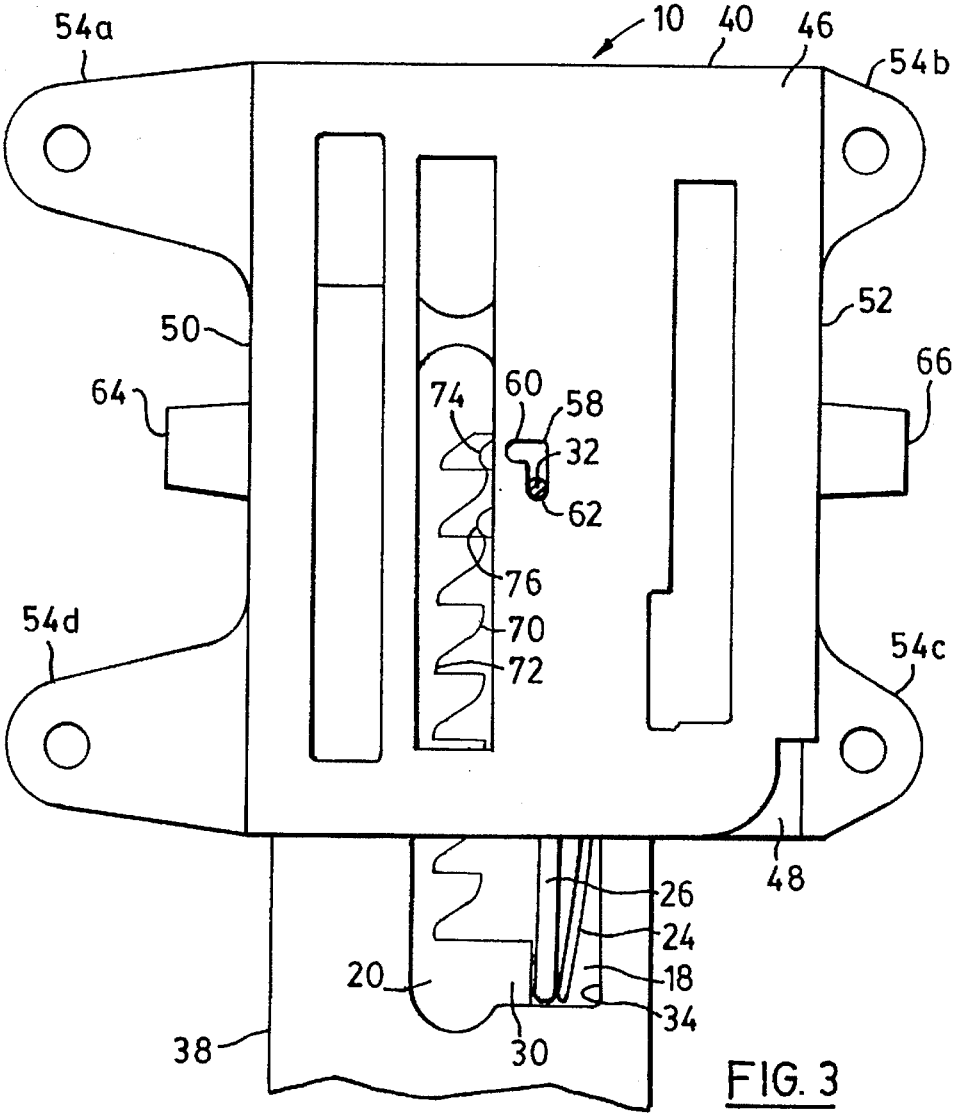
FIG. 3 is another detailed elevational view of part of the chair back adjusting mechanism of the chair of FIG. 1.
Figure 3A:
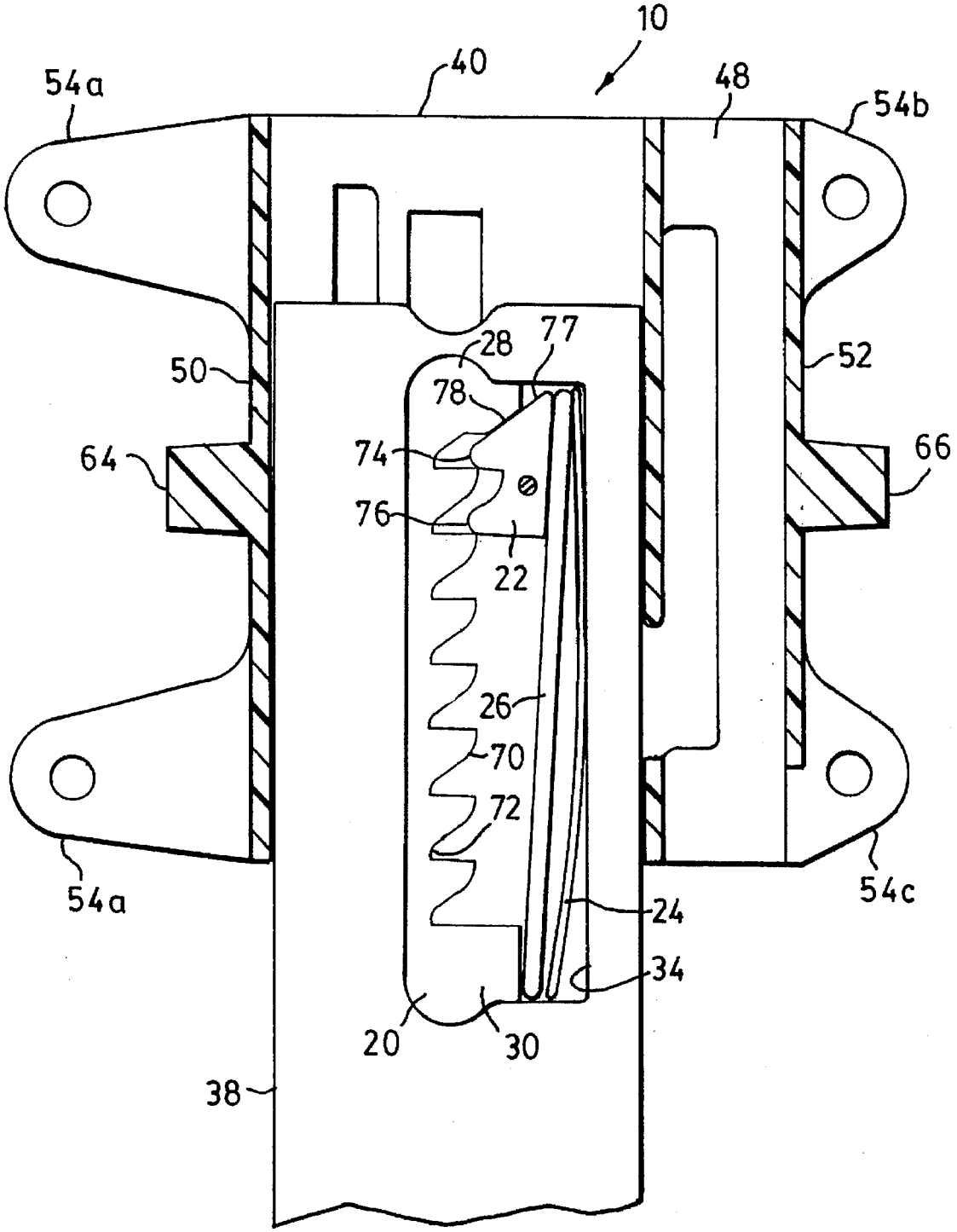
FIG. 3A is a cut-away view of FIG. 3.
Figure 4:
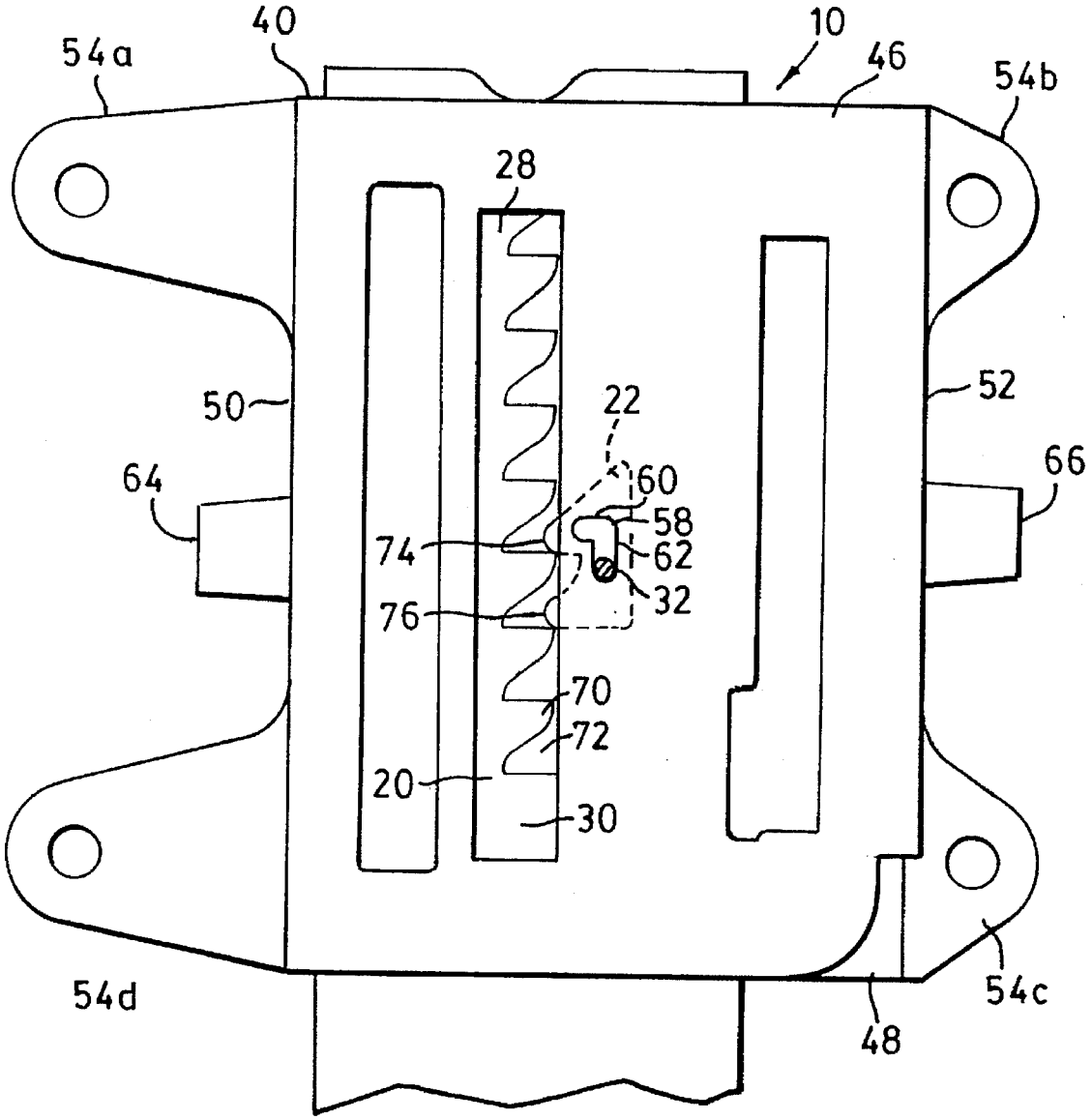
FIG. 4 is another detailed elevational view of part of the chair back adjusting mechanism of the chair of FIG. 1.

As shown in FIG. 2, beginning with slider 40 in a locked position, pawl 22 engages ratchet rack 20. In such a locked position slider 40, which is sealed to chair back 10, may be pulled upwardly away from chair seat 14. Conveniently, grips 64 and 66 may be used to pull slider 40. As the slider 40 is pulled upward, pawl 22 is pulled upward by retaining pin 32 resting in guides 58. Pawl 22, in turn moves upwardly and horizontally away from rack 20 as it passes by a tooth 70 of rack 20. This motion of pawl 22 is caused by the interaction of pawl 22 and rack 20. During this motion, retaining pin 32 slides in the horizontal portion of guides 58 in a direction perpendicular to the direction of motion of slider 40, and generally away from ratchet rack 20. As pawl 22 slides in this direction, a force is exerted on biasing bar 26 toward wall 74, this force is resisted by a force in the opposite direction, provided by leaf spring 24. As teeth 74 and 76 of pawl 22 slide past teeth 70 of ratchet rack 22, the force exerted by leaf spring 24, forces pawl 22 to return into engagement with rack 20. Specifically, teeth 74 and 76 of pawl 22 engage gaps 72 of rack 20. As illustrated in FIG. 2C, the interacting shapes of teeth 70 of ratchet rack 20 and teeth 74, 76 of pawl 22, allow pawl 22 to only be slid from rack 20 in an upward direction. Thus, the engagement of rack 20 by pawl 22 allows for one way sliding of slider 40 in an upward direction along arm 38 away from chair seat As illustrated in FIGS. 3 and 4, once pawl 22 is slid to the top of rack 20, (proximate spacer 28) camming surface 77 of pawl 22 will abut camming surface 78 within cut-out 18. At this point further upward force on slider 40 will exert a force in the horizontal direction on pawl 22 and retaining pin 32. Ultimately, retaining pin 32 will be forced to an end of the horizontal portion 60 of guides 58. At this point, further upward force on slider 40 will force retaining pin 32 downward in guides 58 and into the vertical portion 62 of guides 58. Once retaining pin 32 is within this vertical portion of guides 58, pawl 22 no longer engages ratchet rack 20. Moreover, the force exerted by leaf spring 24 is resisted by a forward wall of the vertical portion 62 of guides 58.

Figure 4A:
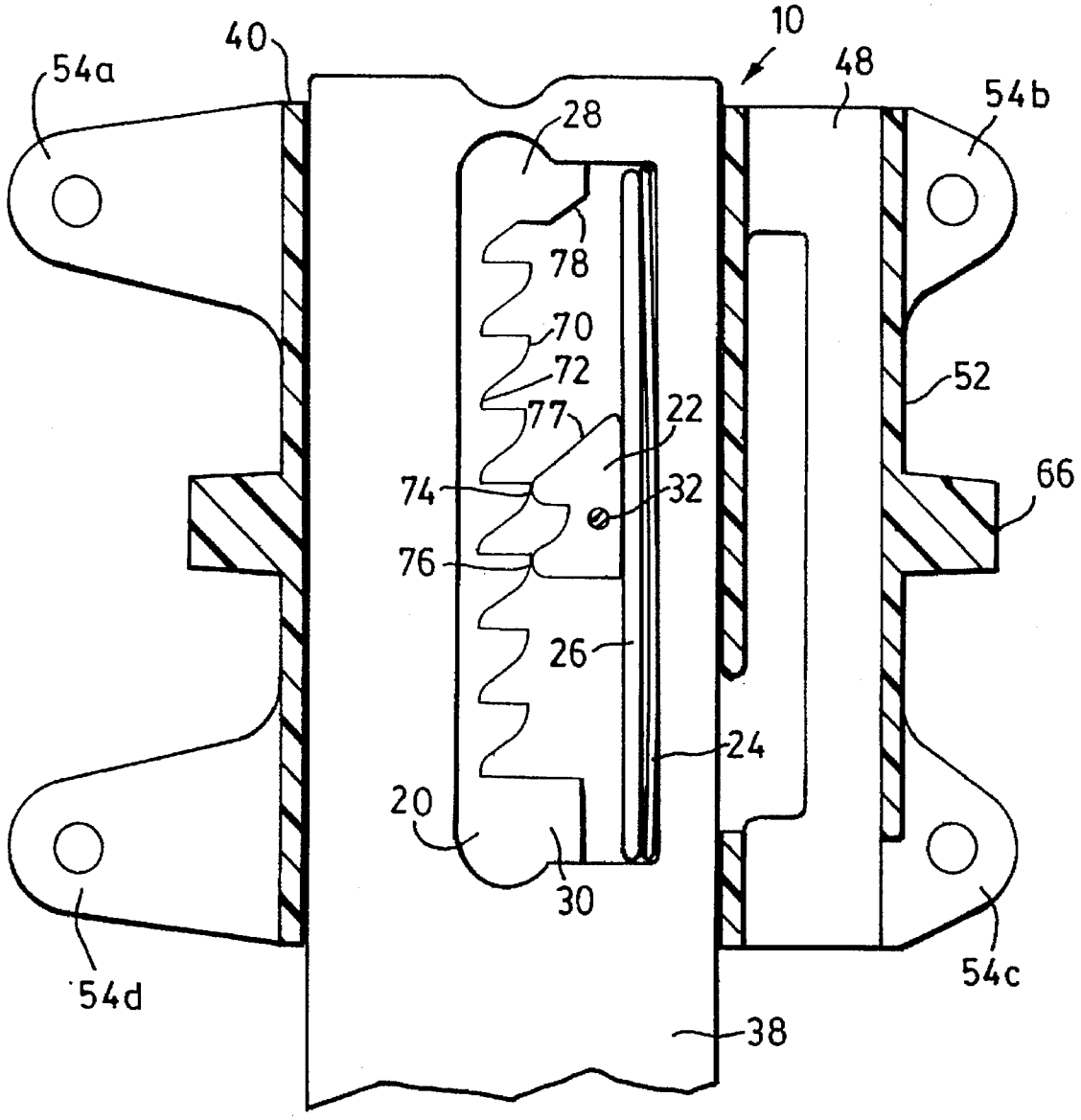
FIG. 4A is a cut-away view of FIG. 4.

As illustrated in FIGS. 4 and 4A, pawl 22 is thus effectively locked in a position of non-engagement relative to rack 20. Further upward force on slider 40 merely forces retaining pin to the bottom of guides 58. At this point, as pawl 22 does not engage rack 20, downward motion of slider 40 is unfettered and it may be slid in a downward direction along arm 38. As slider 40 is slid downward, pawl 22 follows within cut-out 18. Retaining pin 32 is maintained in the vertical portion 62 of guides 58 by the force of friction between retaining pin 32 and the walls of guides 58.

As illustrated in FIGS. 2 and 2A, once slider 40 reaches the bottom of its path, a bottom surface of pawl 22 abuts bottom wall of cut-out 18. Further downward motion of slider 40 cause retaining pin 32 to travel upward along the vertical portion of guides 58. As retaining pin 32 reaches the top of the vertical portion 62 of guide 58, it enters horizontal portion 60 of guides 58. At this point, the force exerted by biasing spring 24 on biasing bar 26 and in turn on pawl 22 causes retaining pin 32 to travel along horizontal portion 62 of 58. Pawl 22 accordingly travels toward ratchet rack 20, until teeth 74, 76 of pawl 22 are once again in engagement with the gaps 72 of ratchet rack 20. At this point, once again only upward motion of slider 40 is possible.

Thus, to downwardly adjust the position of chair back 16 using this mechanism, slider 40 must be slid to the top of its path and then returned to the bottom of the path. Thereafter it may be slid to final desired vertical position.

A person skilled in the art will readily understand that a device in accordance with this invention is well suited for adjusting the position of a wide variety of structural members relative to other structural members.

Figure 5:
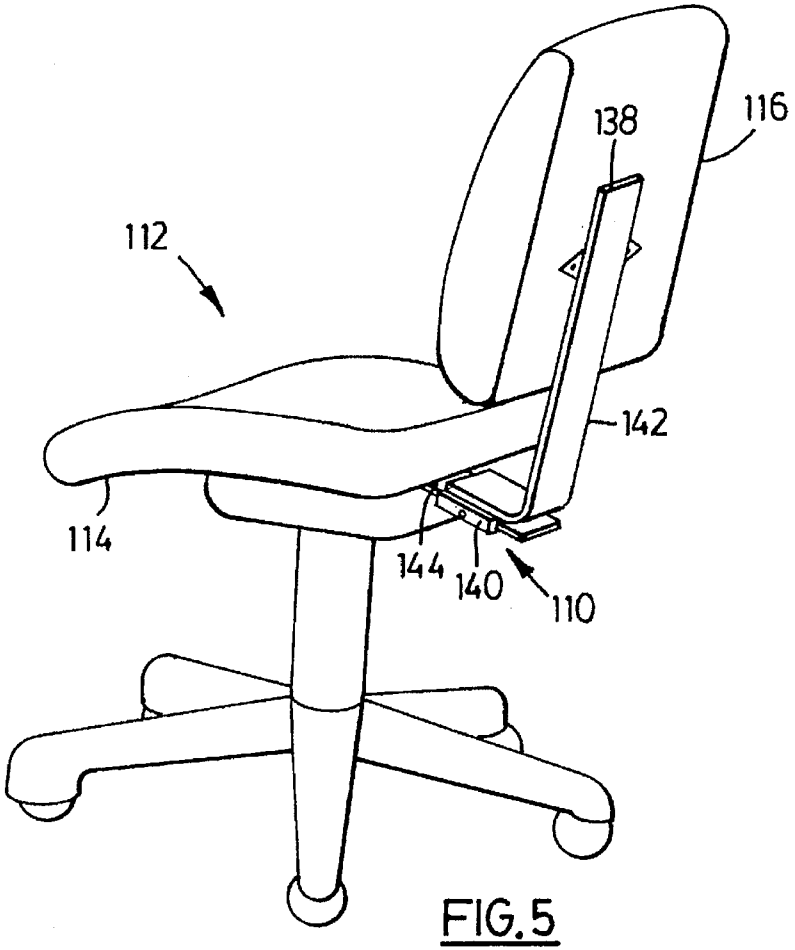
FIG. 5 illustrates an office chair incorporating an adjusting mechanism in accordance with another embodiment of this invention that is adapted for adjusting the lateral position of a chair back relative to a chair seat.

As shown in FIG. 5, illustrating a second preferred embodiment, the invention may be easily implemented to adjust the lateral position of chair back 116 relative to chair seat 114. In such a second preferred embodiment the orientation of the adjusting mechanism is altered to provide for horizontal movement of the chair back 116 relative to seat 114. Slider 140 engages an arm 144 extending from chair seat 114 in a plane generally parallel to the upward facing, seating surface of chair seat 114. Slider 140 is secured to chair back 116 by way of a generally L-shaped bracket 142. L-shaped bracket 142 extends from a top wall of slider 140, and is attached by way of fasteners to chair back 116. As in the previous embodiment, arm 144 has a cut-out portion (not shown) virtually identical to cut-out 28 of the first preferred embodiment. Within this cut-out is a ratchet rack, which is resiliently engaged by a pawl supported by slider 140. As in the first preferred embodiment, the interaction of the pawl and ratchet rack permits only one directional movement of slider 140 along arm 144 when the pawl engages the rack. In this embodiment, slider 140 may only be slid toward chair seat 114 when the pawl engages the rack. Motion of chair back 116 away from chair seat 114 is prevented by the engagement by the pawl of the ratchet rack. Once the chair back has been moved to its forward most position near seat 114, the pawl disengages the rack, as described above, and the chair back may be slid away from chair seat 114. Once chair back 116 is pulled to its maximum extension from seat 114, the interaction of the pawl and a cam surface within the cut-out, causes the pawl to be forced into engagement with the ratchet rack, thereby once again, allowing one-directional motion of chair back 116 toward seat 114. Thus, in order to adjust the seat back outwardly, a user must first guide the chair back to its position closest to seat 114. Thereafter the seat back must be adjusted to its maximum extension from seat 112 and then guided toward chair seat 114 to its desired position.

Figure 6:
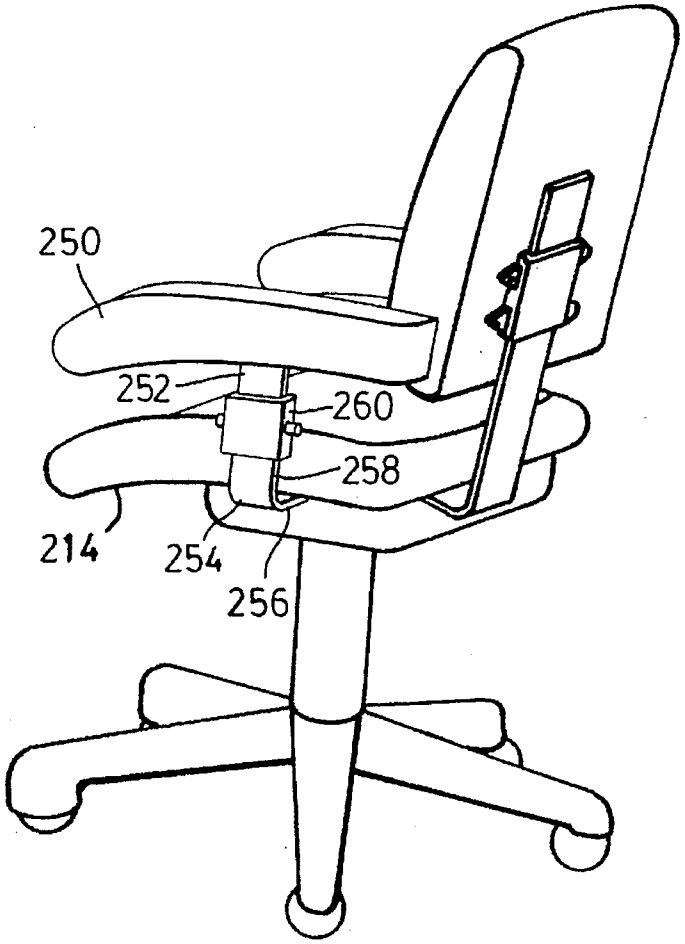
FIG. 6 illustrates an office chair incorporating an adjusting mechanism in accordance with yet another embodiment of this invention that is adapted for adjusting the vertical position of a chair armrest relative to a chair seat.

Similarly, the same adjustment device may be installed on chair armrests as shown in the third preferred embodiment of FIG. 6, thereby permitting one handed vertical adjustment of these armrests. In such an embodiment, slider 260 connects armrest 250 to chair seat 214. Slider 260 engages arm 254 which extends from chair seat 214. Arm 254 has a portion 256 extending from seat 214 generally parallel to seat 214 and a further portion 258 extending upward from seat 214. Bracket 252 extends from arm rest 250 and is connected to a rear wall of slider 260. As in the embodiment of FIGS. 1–4A, slider 260 supports a pawl which resiliently engages a racket rack in a cut-out of arm 254. While the pawl engages the ratchet rack, armrest 250 may only be slid upwardly, away from seat 216 along arm 254. Once the armrest is slid to its maximum extension from seat 214, the pawl is disengaged from the ratchet rack and the armrest may be slid downwardly toward seat 214. Thus, in order to adjust armrest 250 downwardly a chair user must first guide the armrest to its upward most position, where the pawl no longer engages the ratchet rack. Thereafter armrest 250 may be pushed freely downward along arm 254, to its position closest to seat 214, and then guided upwardly toward its desired position.

Obviously, the above preferred embodiments may be modified and combined. Additionally, various other uses for the adjusting mechanism are envisaged. For example, an adjusting mechanism according to this invention may be used for vertically positioning storage or bookshelves.

Additionally, of course, numerous structural modifications may also be made within the scope of the present invention. For example in the first embodiment, guides 58 need not be entirely vertical or horizontal, but only require a component in the direction of rack 20 and a further component transverse to rack 20. The cam follower need not be a retaining pin, but may be formed as an integral part of pawl 22. Leaf spring 24 may be replaced by a similar resilient mechanism, such as a number of coiled springs. The cam guide may be located in the pawl, and retaining pin 32 may be fixedly attached to the walls of the slider. Outer walls 46 and 48 need not form a channel, but may be alternatively guided along arm 38. Similarly, cam guides 58 need not be a slot, but may simply be a groove.

It will be further understood that the invention is not limited to the illustrations described and shown herein, which are deemed to be merely illustrative of the best mode of carrying out the invention, and which are susceptible to modification of form, size, arrangement of parts and details of operation. The invention, rather, is intended to encompass all such modifications which are within its spirit and scope as defined by the claims.

I claim:

1. A chair back adjusting mechanism, comprising an arm, mountable to a chair seat to extend therefrom;

a slider securable to a chair back and adjusted to slidably engage said arm;

a ratchet rack on said arm;

a pawl supported by said slider adapted to engage said ratchet rack;

one of said slider and said pawl having a cam guide, said guide having a substantially horizontal portion extending in a direction substantially transverse to said rack, and a substantially vertical portion interconnected to said substantially horizontal portion and extending in a direction substantially parallel to said rack from said substantially horizontal portion;

the other of said slider and said pawl having a cam follower extending therefrom, said cam follower slidably engaging said cam guide;

a biasing member resiliently urging said pawl into engagement with said ratchet rack and urging said cam follower along said substantially vertical portion of said cam guide;

said arm having a first surface and said pawl having a first surface arranged such that when said pawl first surface is pushed into abutment with said arm first surface said cam follower is forced along said substantially horizontal cam guide portion and into said substantially vertical cam guide portion;

said pawl being disengaged from said ratchet rack when said cam follower is positioned in said substantially vertical portion of said cam guide;

said arm having a second surface such that when said pawl is pushed into abutment with said second surface of said arm said cam follower is forced from said substantially vertical portion and into said substantially horizontal portion of said cam guide.

2. A chair back adjusting mechanism as in claimed in claim 1, further comprising means to retain said cam follower in said vertical portion when said pawl is moved form a position in abutment with said arm first surface to a position in abutment with said arm second surface.

3. A chair back adjusting mechanism as claimed in claim 2, wherein said ratchet rack comprises a top and bottom and wherein said arm first surface is a first abutting surface and is located proximate said top of said ratchet rack and said arm second surface is located proximate said bottom of said ratchet rack.

4. A chair back adjusting mechanism as claimed in claim 3, wherein said cam follower comprises a retaining pin and said cam guide comprises a cam slot, said retaining pin extending through said cam slot.

5. A chair back adjusting mechanism as claimed in claim 4, wherein said biasing member comprises a leaf spring received by said arm.

6. A chair back adjusting mechanism as claimed in claim 5 wherein said biasing member further comprises a biasing bar in said arm in engagement with said leaf spring and said pawl.

7. A chair back adjusting mechanism as claimed in claim 6 further comprising upper and lower spacers proximate said top and bottom of said ratchet rack, for establishing a fixed spacing distance between said biasing bar and said rack proximate said top and bottom of said rack.

8. A chair back adjusting mechanism as claimed in claim 4 wherein said slider defines a channel for guiding said slider along said arm.

9. A chair back adjusting mechanism as claimed in claim 8 wherein said channel is formed by opposing walls of said slider and wherein said retaining pin extends through said channel and extends into said opposing walls of said slider.

10. A chair back adjusting mechanism as claimed in claim 9 wherein said cam slot is disposed in one of said opposing walls of said slider and wherein a second cam slot is disposed in a second one of said opposing walls, directly opposite said first cam slot.

11. A chair back adjusting mechanism as claimed in claim 10, wherein said opposing walls are interconnected by side walls and wherein said opposing walls and said side walls are integrally formed.

12. A chair back adjusting mechanism as claimed in claim 2, wherein said means to retain said cam follower comprises a surface on said cam guide and a surface on said cam follower and wherein said cam guide surface exerts sufficient force on said cam follower to retain said cam follower in said vertical portion when said pawl is moved from a position in abutment with said arm first surface to a position in abutment with said arm second surface.

13. An adjusting mechanism for adjusting the position of a first structural member relative to a second structural member, comprising an arm mountable to said first structural member to extend thereform;

a slider securable to said second structural member and adapted to slidably engage said arm;

a ratchet rack on said arm;

a pawl supported by said slider adapted to engage said ratchet rack;

one of said slider and said pawl having a cam guide, said guide having a first guide portion extending in a direction substantially transverse to said rack, and a second guide portion interconnecting to said first guide portion and extending in a direction substantially parallel to said rack from said first guide portion;

the other of said slider and said pawl having a cam follower extending therefrom, said cam follower slidably engaging said cam guide;

a biasing member resiliently urging said pawl into engagement with said ratchet rack and urging said cam follower along said first guide portion of said cam guide away from said second guide portion;

said arm having a first surface and said pawl having a first surface arranged such that when said pawl first surface is pushed into abutment with said arm first surface said cam follower is forced along said first guide portion and into said second guide portion;

said pawl being disengaged from said ratchet rack when said cam follower is positioned in said substantially second portion of said cam guide;

said arm having a second surface such that when said pawl is pushed into abutment with said second surface of said arm said cam follower is forced from said substantially second guide portion and into said first guide portion of said cam guide.

14. An adjusting mechanism as claimed in claim 13, further comprising means to retain said cam follower in said second guide portion when said pawl is moved from a position in abutment with said arm first surface to a position in abutment with said arm second surface.

15. An adjusting mechanism as claimed in claim 14, wherein said ratchet rack comprises a top and bottom and wherein said arm first surface is a first abutting surface and is proximate a first end of said ratchet rack and said arm second surface is located proximate a second end of said ratchet rack.

16. An adjusting mechanism as claimed in claim 15, wherein said cam follower comprises a retaining pin and said cam guide comprises a cam slot, said retaining pin extending through said cam slot.

17. An adjusting mechanism as claimed in claim 16, wherein said biasing member comprises a leaf spring received by said arm.

18. An adjusting mechanism as claimed in claim 17 wherein said biasing member further comprises a biasing bar in said arm in engagement with said leaf spring and said pawl.

19. An adjusting mechanism as claimed in claim 18 further comprising upper and lower spacers proximate said first and second end of said ratchet rack, for establishing a fixed spacing distance between said biasing bar and said rack proximate said first and second end of said rack.

20. An adjusting mechanism as claimed in claim 16 wherein said slider defines a channel for guiding said slider along said arm.

21. An adjusting mechanism as claimed in claim 20 wherein said channel is formed by opposing walls of said slider and wherein said retaining pin extends through said channel and extends into said opposing walls of said slider.

22. An adjusting mechanism as claimed in claim 21 wherein said cam slot is disposed in one of said opposing walls of said slider and wherein a second cam slot is disposed in a second one of said opposing walls, directly opposite said first cam slot.

23. An adjusting mechanism as claimed in claim 22, wherein said opposing walls are interconnected by side walls and wherein said opposing walls and said side walls are integrally formed.

24. An adjusting mechanism as claimed in claim 23, wherein said means to retain said cam follower comprises a surface on said cam guide and a surface on said cam follower and wherein said cam guide surface exerts sufficient force on said cam follower to retain said cam follower in said second guide portion as said pawl is moved form a position in abutment with said arm first surface to a position in abutment with said arm second surface.

* * * * *

UNITED STATES PATENT AND TRADEMARK OFFICE

CERTIFICATE OF CORRECTION

PATENT NO. : 5,649,741

DATED : July 22, 1997

INVENTOR(S) : Ken A. Beggs

It is certified that error appears in the above-indentified patent and that said Letters Patent is hereby corrected as shown below:

In column 2, line 56, after "2B-2B in", insert --FIG. 2A;--.

In column 4, line 54, after "chair seat", insert --14.--.

In column 7, line 19, after "as", delete --in--.

In column 7, line 21, change "form" to --from--.

In column 8, line 7, change "thereform" to --therefrom--.

In column 10, line 9, change "form" to --from--.

Signed and Sealed this

Twenty-eighth Day of October, 1997

*Attest:*

Bruce Lehman

BRUCE LEHMAN

*Attesting Officer*

*Commissioner of Patents and Trademarks*